US008485314B2

(12) United States Patent
Danner et al.

(10) Patent No.: US 8,485,314 B2
(45) Date of Patent: Jul. 16, 2013

(54) EXHAUST MUFFLER

(75) Inventors: Tobias Danner, Neu-Ulm (DE); Thorsten Keesser, Augsburg (DE); Thorsten Linde, Augsburg (DE); Christine Huth, Augsburg (DE); Marco Ranalli, Augsburg (DE)

(73) Assignee: Faurecia Emissions Control Technologies, Germany GmbH, Augsburg (DE)

( * ) Notice: Subject to any disclaimer, the term of this patent is extended or adjusted under 35 U.S.C. 154(b) by 0 days.

(21) Appl. No.: 13/502,536

(22) PCT Filed: Oct. 20, 2010

(86) PCT No.: PCT/EP2010/006420

§ 371 (c)(1),
(2), (4) Date: Jul. 2, 2012

(87) PCT Pub. No.: WO2011/047852

PCT Pub. Date: Apr. 28, 2011

(65) Prior Publication Data

US 2012/0267191 A1 Oct. 25, 2012

(30) Foreign Application Priority Data

Oct. 20, 2009 (DE) ..... 10 2009 049 969

(51) Int. Cl.
*F01N 13/18* (2010.01)

(52) U.S. Cl.
USPC ..... 181/282; 181/246

(58) Field of Classification Search
USPC ..... 181/282, 246
See application file for complete search history.

(56) References Cited

U.S. PATENT DOCUMENTS

| | | | | |
|---|---|---|---|---|
| 4,239,091 | A * | 12/1980 | Negrao | 181/243 |
| 4,993,513 | A * | 2/1991 | Inoue et al. | 181/282 |
| 5,440,083 | A * | 8/1995 | Masuda | 181/240 |
| 5,468,923 | A * | 11/1995 | Kleyn | 181/282 |
| 6,543,577 | B1 * | 4/2003 | Ferreira et al. | 181/282 |
| 7,810,609 | B2 * | 10/2010 | Sikes et al. | 181/250 |
| 2004/0262077 | A1 | 12/2004 | Huff | |
| 2009/0194364 | A1 | 8/2009 | Leboeuf | |

FOREIGN PATENT DOCUMENTS

| | | | |
|---|---|---|---|
| DE | 1939197 | A1 | 2/1971 |
| GB | 2129490 | A | 5/1984 |
| NL | 9002281 | A | 5/1992 |
| WO | 9927238 | A1 | 6/1999 |

OTHER PUBLICATIONS

German Search Report dated Feb. 25, 2011.
English translation of Written Opinion/IPER dated May 8, 2012.

* cited by examiner

*Primary Examiner* — Forrest M Phillips
(74) *Attorney, Agent, or Firm* — Pamela A. Kachur

(57) ABSTRACT

An exhaust muffler of an internal combustion engine has pipe sections on the inflow side and on the outflow side, respectively, and a muffler housing that is in communication with the pipe sections. The muffler housing, which includes an outer casing and end walls, is made at least in sections of a plastic material.

21 Claims, 4 Drawing Sheets

EXHAUST MUFFLER

CROSS-REFERENCE TO RELATED APPLICATION

This is the U.S. national phase of PCT/EP2010/006420, filed Oct. 20, 2010, which claims priority to German Patent Application No. 10 2009 049 969.5, filed Oct. 20, 2009.

TECHNICAL FIELD

The present invention relates to an exhaust muffler of an internal combustion engine, which includes at least one pipe section on the inflow side and at least one pipe section on the outflow side, and a muffler housing that is in communication with the pipe sections.

BACKGROUND OF THE INVENTION

Exhaust mufflers for internal combustion engines are known. They are produced from sheet metal parts. The manufacture of the known exhaust mufflers is effected by producing individual parts, such as, for example, the end walls and an outer casing, which are connected to each other by welding or brazing.

There is a need to provide a novel exhaust muffler which distinguishes itself in particular by a lower weight.

SUMMARY OF THE INVENTION

An exhaust muffler includes a muffler housing that is made at least partly of a plastic material. Because of the high temperatures, plastic materials have not so far been contemplated for mufflers. The invention, however, exactly makes provision for the application of plastics in the housing itself, the respective wall being comprised only of plastics over an entire thickness in this area of the muffler housing.

In comparison with a muffler housing that is manufactured entirely from metal, the housing made partly of a plastic material is lighter and more cost-effective.

In one example, the interior of the muffler housing is not completely filled with a sound absorbing material. According to one embodiment, only a maximum of 30% of the interior between the gas-carrying pipe and the housing is filled with an absorbing material. Of special importance are those embodiments in which even no sound absorbing material at all is stuffed into the interior of the muffler housing as filling material. Such a sound absorbing material is more particularly a type of wool.

The muffler housing may be in one piece or composed of several parts, and includes an outer casing and end walls. In one embodiment, the end walls are in direct communication with the pipe sections. Therefore, it is beneficial to produce the end walls from a metallic material having a good thermal stability, whereas the outer casing, which is spatially more remote from the pipe sections and is therefore thermally loaded to a lesser extent, is made partly of a plastic material.

Preferably, the outer casing continues in one piece into at least one of the end walls.

It is of advantage to provide a thermally insulating material at least in sections for the end walls. Here a material is referred to as a thermally insulating material which has a coefficient of thermal conduction that is lower than that of the plastic material and lower at least by a factor of 5 than that of the metallic end wall sections and pipe sections. In this way, the heat conduction to the outer casing can be reduced.

It is just as effective and easy on the plastic material portions of the outer casing if cooling fins are arranged on the end wall or the exhaust muffler housing. The cooling fins may be attached to a transition between the end wall and the adjacent pipe section in the same way.

In a further embodiment, a cylindrical sleeve having radial cooling fins is inserted between an end wall made of a plastic material and the adjacent pipe section. In this manner, the heat released by the exhaust gas to the components through which it flows is dissipated to the outside already at an early point in time.

For a further protection of the plastic material, the sleeve may additionally or alternatively be manufactured from a thermally insulating material; the above-mentioned definition of a thermally insulating material shall be applicable here as well.

A surface enlargement to achieve a cooling effect may, of course, also be attained by other known design measures.

One embodiment of an exhaust muffler includes a connector ring which encloses the outer edges of the end walls and constitutes the transition to the outer casing.

The connector ring is preferably manufactured from a thermally insulating material.

The connector ring may be a steel ring, for example, which is embedded in the outer casing and welded to the pipe section. A desirable thermal decoupling between the pipe section and the outer casing of the exhaust muffler is obtained by this design measure as well.

An embodiment in which the pipe sections which are located in the interior of the muffler housing have radial openings has turned out to be particularly favorable. Owing to these radial openings, the interior of the pipe is open towards a muffling space. The radial openings may also be microperforations.

A further embodiment includes, particularly, a metallic protective wall which is arranged between the thermally loaded pipe section and the outer casing and which effects a thermal shielding to protect sensitive parts made of plastics. This protective wall is intended in particular to prevent parts from being struck by a direct flow of hot exhaust gas exiting from the pipe section.

At least one side of the protective wall is fastened to a pipe section, for example. In an optimum fashion, the protective wall is connected at least with the pipe section on the inflow side. It may be open on the opposite side, that is, on the outflow side, so that the exhaust gas passes through the openings in portions of the pipe section and first into the space between the pipe section and the protective wall, and then fills the entire muffling space in the interior of the exhaust muffler.

The protective wall may just as well be firmly connected with both pipe sections, i.e. that on the inflow side and that on the outflow side. This double fastening of the protective wall increases the mechanical stability of the exhaust muffler, above all with respect to shocks, and thus increases its service life.

The protective wall in the interior of the exhaust muffler may extend over a limited portion of the pipe section or over the entire axial length of the muffler housing. In this case, the protective wall is also fastened to the end faces of the outer casing.

In one embodiment, portions of the pipe section and also portions of the protective wall have radial openings, in particular microperforations. In this way, the desired muffling and the protection of the plastic housing section from being directly struck by the gas flow are realized.

In a further embodiment, the protective wall forms a radially outer delimitation for the muffling space and is separated from the outer casing of the muffler housing by an air gap. This air gap constitutes an insulation cushion and has a particularly advantageous effect as a protection from a temperature load on the outer casing.

One embodiment includes a protective wall which projects through the muffler housing on both sides. In this embodiment, the end walls of the muffler housing are fastened to the protective wall. In this way, the protective wall encompasses an even larger portion of the pipe sections through which the exhaust gas flows than in the previously described embodiments, which causes an even more effective decrease in temperature. Furthermore, the end wall is still further thermally decoupled from the hot pipe sections.

In order to obtain both a thermal protective function and a muffling function, it is preferred if the protective wall is provided with radial openings, in particular with microperforations.

The sections of the muffler housing that are comprised of a plastic material may include stiffening ribs extending into the interior of the housing, the protective wall being mounted on an inside of the stiffening ribs, i.e. on a side facing the inside of the housing. The stiffening ribs take over an important static function for the mechanical stabilization of the exhaust muffler and at the same time serve as spacers and bearing for the protective wall, which is formed as a microperforated foil, for example.

In a further embodiment, at least one support wall formed as an annular disk is arranged in the interior of the muffler, the support wall preferably being comprised of a metallic material. The at least one annular disk is preferably connected, more particularly welded, to the pipe section. The annular disk further rests against the outer casing of the muffler housing and is arranged between the two end walls thereof. The annular disk contributes to the mechanical stability of the muffler, on the one hand, and also has effects on the temperature distribution in the interior of the muffler housing since the annular disk causes a division of the muffler housing into smaller segments.

It is particularly advantageous if the outer casing of the muffler housing in sections comprises metal and in sections comprises plastic material. This can be realized, for example, by fitting together individual cylindrical rings which include suitable connectors. But it is also known to connect metal parts with each other by a plastics injection molding technique, so that plastic material sections are formed between the metal parts.

In a further embodiment, the metallic sections in the outer casing are arranged such that they are positioned in particular in the region of the support wall. In this way, portions of the outer casing which are exposed to particularly high temperature loads can be manufactured from metal. The material of the outer casing can in this way be adjusted to the actually occurring temperature gradient.

A further embodiment of an exhaust muffler distinguishes itself in that the muffling space between the pipe section and the outer casing of the muffler housing is filled with a sound absorbing material. The sound absorbing material can also have an additional supporting effect on the heat dissipation.

A favorable effect on the temperature stability of the outer casing made of a plastic material is provided by an internal coating made from a thermally more stable material than the plastic material, for example a microperforated metal foil. Many different coating systems and methods are known. A metallic or ceramic coating is in particular also suitable for the internal coating for the outer casing of the muffler.

It is also advantageous to make provision in the housing for two pipes with an axial offset of their perforations in sections. The exhaust gas flows in via the inner pipe, passes via the perforations into the outer pipe and via the latter, axially offset, from the outer pipe into the space between the outer pipe and the housing.

BRIEF DESCRIPTION OF THE DRAWINGS

Further advantages of the exhaust muffler according to the invention will be apparent from the description below and from the drawings, to which reference is made and in which.

DETAILED DESCRIPTION

Figure 1:
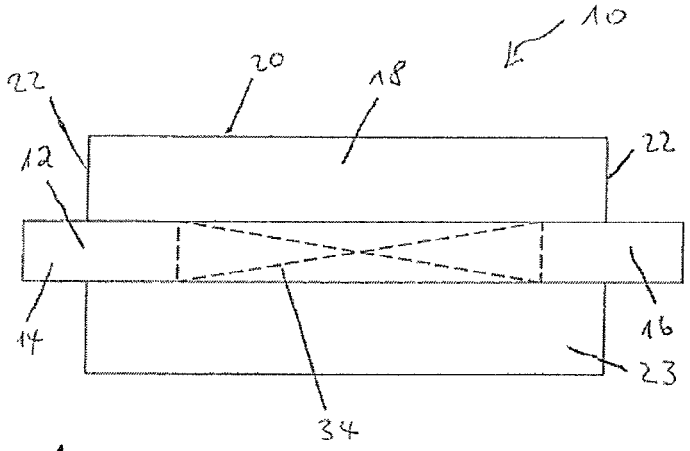
FIG. 1 shows a longitudinal sectional view of an exhaust muffler according to a first embodiment of the invention.

FIG. 1 shows an exhaust muffler 10 as used in a vehicle downstream of an internal combustion engine.

The exhaust muffler 10 essentially comprises a pipe 12 having a pipe section 14 on an inflow side and a pipe section 16 on an outflow side, and a muffler housing 18.

The pipe 12 is typically manufactured from a metallic material because, by nature, very hot exhaust gases flow through it, and metal is of an excellent suitability for high temperature loads.

The muffler housing 18 includes a more particularly cylindrical outer casing 20 and end walls 22.

In the embodiment according to FIG. 1, the outer casing 20, at least in sections, comprises a plastic material, whereas the end walls 22, in particular facing the pipe sections 14 and 16, are made of metal to ensure the thermal stability in this region. In this embodiment, the end walls 22 are directly connected with the pipe sections 14, 16.

A central portion of the pipe 12 is provided with radial openings 34, here in particular microperforations, to open the pipe 12 towards the so-called "muffling space 23," which serves for muffling.

Figure 2:
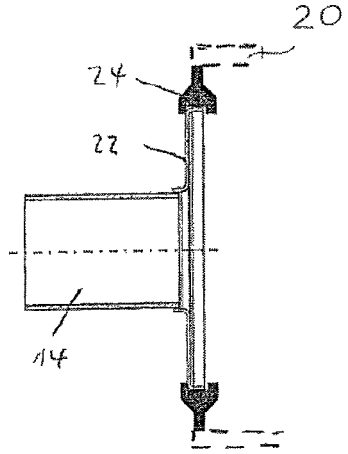
FIG. 2 shows a longitudinal sectional view of an alternative embodiment of an exhaust muffler according to the invention in the transition region between the pipe section and the muffler housing.
Figure 3:
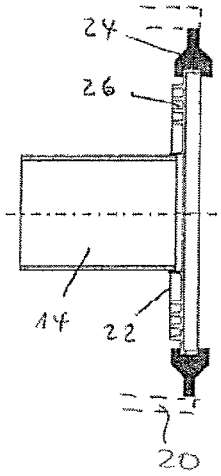
FIG. 3 shows a longitudinal sectional view of an alternative embodiment of an exhaust muffler according to the invention in the transition region between the pipe section and the muffler housing.
Figure 4:
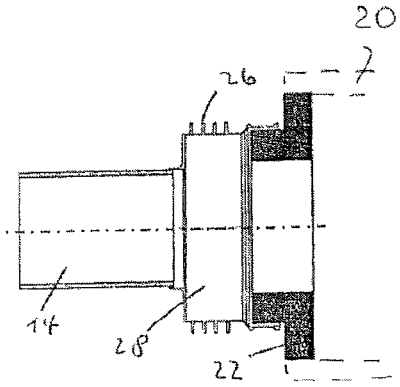
FIG. 4 shows a longitudinal sectional view of an alternative embodiment of an exhaust muffler according to the invention in the transition region between the pipe section and the muffler housing.

FIG. 2 to 4 represent various measures to thermally decouple, to the greatest possible extent, the sections of the outer housing 18 that comprised of a plastic material from the highly thermally loaded pipe sections 14, 16.

In the embodiment according to FIG. 2, the metallic pipe section 14 transitions into the preferably likewise metallic end wall 22. To thermally decouple the outer casing 20 made of a plastic material from the hot end wall 22, a connector ring 24 made from a thermally insulating material is provided on the outer radial external circumference of the end wall 22; the outer casing 20 made of a plastic material is, in turn, directly fastened to the connector ring 24. In the embodiment shown here, the connector ring 24 is provided with a groove into which the end wall 22 engages for a sealing contact therewith.

For a further thermal decoupling it may be advantageous if the end wall 22 is provided with cooling fins 26 as shown in FIG. 3. It is achieved by this measure as well that the temperatures to which the outer casing 20 is subjected are so low that the plastic material is not thermally overloaded.

FIG. 4 shows a preferred embodiment in which at least one end wall 22 of the muffler housing 18 comprises a plastic material, and a cylindrical sleeve 28 including radial cooling fins 26 is arranged between the pipe section 14, 16 and the end wall 22. The surface of the sleeve 28 is enlarged by the cooling fins 26, so that an efficient heat exchange with the surroundings occurs and the end wall 22 of plastics is only exposed to a reduced amount of heat.

It is particularly beneficial if the sleeve 28 or the connector ring 24 comprises a material having a low thermal conductivity or even a thermally insulating effect.

But the connector ring 24 according to FIG. 2 to 4 may also be omitted, and the outer casing 20 may have an integrally molded extension on the end face which corresponds in shape to the connector ring 24 shown in FIG. 2 to 4.

Figure 5:
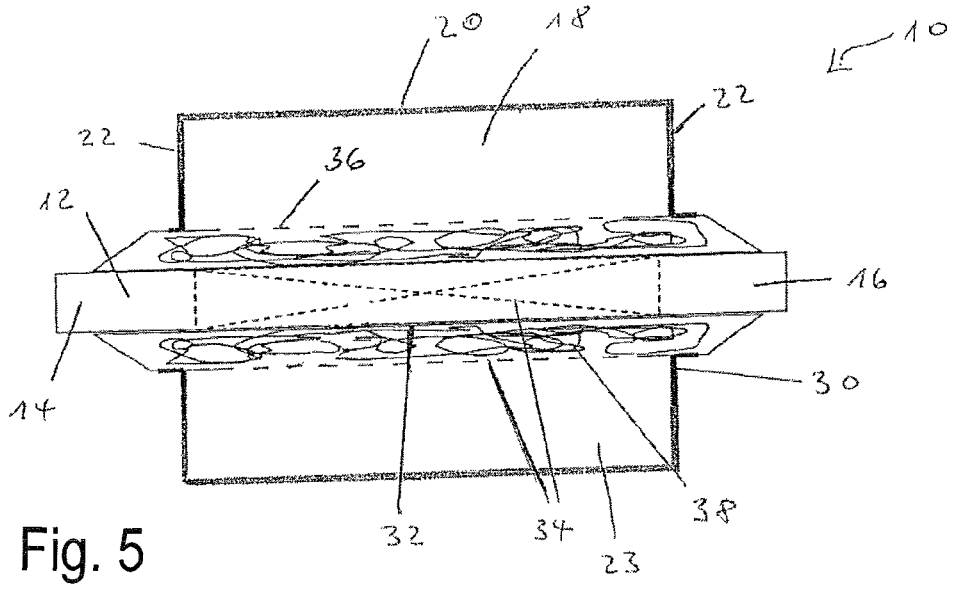
FIG. 5 shows a longitudinal sectional view of an exhaust muffler according to the invention with a tubular protective wall.

In the embodiment according to the invention as shown in FIG. 5, a special transition in the form of a connector ring 30 is provided between the inner edges, enclosed by the connector ring 30, of the end walls 22 and the pipe sections 14, 16. The connector ring 30 is preferably made of steel or a thermally insulating material and is embedded into the plastic material of the end walls 22, for example using an injection molding method. The end walls 22 continue in one piece into the outer casing 20. The connector rings 30 also contribute to the good mechanical stability of the outer casing 20.

In the interior of its housing 18, the exhaust muffler 10 includes pipe sections which are provided with radial openings 34 at least over a portion 32.

Here, too, the radial openings 34 may be microperforations. Microperforations enhance the muffling effect.

A more particularly metallic protective wall 36 is arranged in the interior of the muffler housing 18 between the pipe section 14, 16 and the outer casing 20.

The protective wall 36 is of an essentially tubular design, for example, and has an inside diameter that is larger than the outside diameter of the pipe section 14, 16. The protective wall 36 shields the outer casing 20, which is made at least partly of a plastic material, from a direct exposure to heat by exhaust gas.

The protective wall 36 also has radial openings 34 via which the exhaust gas is in communication with a muffling space 23 to form a resonator type muffler.

The protective wall 36 projects through the muffler housing 18 axially on both sides and is firmly connected, in particular welded, to the pipe sections 14 and 16. The connector rings 30 of the end walls 22 are fastened to the protective wall 36. This has the advantage that the pipe sections in the interior of the muffler housing 18 are completely surrounded by the protective wall 36 and, in this way, the end walls 22 and the outer casing 20 are already largely thermally decoupled from the pipe sections 14, 16.

The space 38 between the pipe section 14, 16 and the protective wall 36 is preferably filled with a sound absorbing material. The sound absorbing material may additionally have a heat insulating effect, and it is, of course, possible to arrange sound absorbing material also in other places in the muffler 10.

Figure 6:
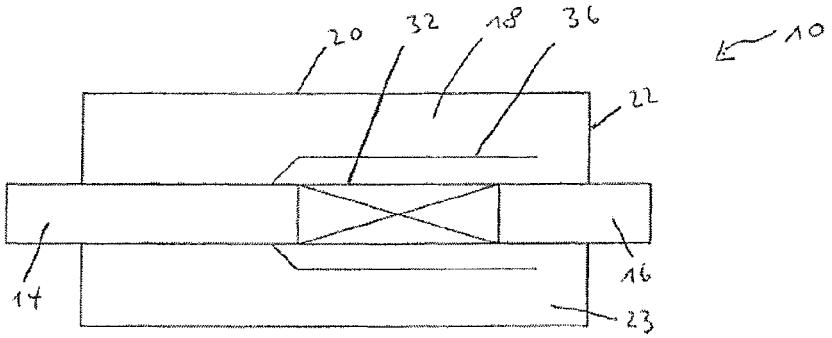
FIG. 6 shows a longitudinal sectional view of a further exhaust muffler according to the invention with the protective wall open on one side.

FIG. 6 shows an exhaust muffler 10 in which the pipe sections 14, 16 project through the muffler housing 18 on both sides on the end walls 22 thereof and have radial openings in the portion 32. Arranged between this portion 32 and the outer casing 20 is a protective wall 36 which is fastened to the pipe section 14 on the inflow side, which is subjected to higher temperatures, and is not fastened to the pipe section 16 on the outflow side in order to form an open end here. The protective wall 36 shields the outer casing 20, which is at least partly made of a plastic material, from an excessive thermal load. The muffling space 23 serves as a resonator type muffler.

Figure 7:
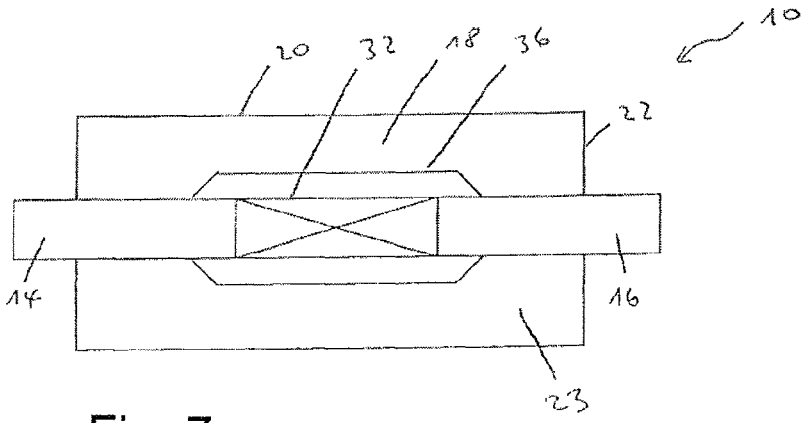
FIG. 7 shows a longitudinal sectional view of a further exhaust muffler according to the invention with the protective wall fastened on both sides.

FIG. 7 illustrates an embodiment of an exhaust muffler 10 which has a structure similar to that of the preceding one, with the difference that the protective wall 36 is fastened both to the pipe section 14 on the inflow side and to the pipe section 16 on the outflow side. The protective wall 36 does not have openings on the end face, so that the muffling space 23 between the outer casing 20 and the protective wall 36 has a highly insulating effect. Radial openings are provided in the peripheral wall of the protective wall 36.

Figure 8:
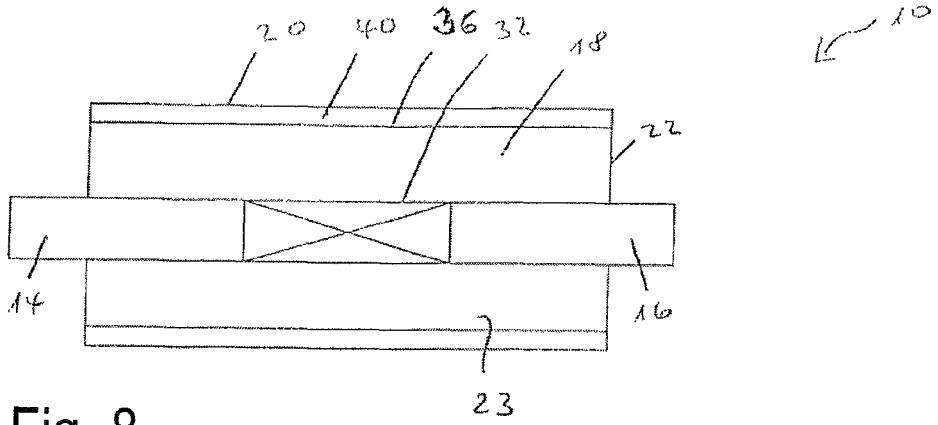
FIG. 8 shows a longitudinal sectional view of yet another exhaust muffler with an air insulation gap.

The embodiment of an exhaust muffler 10 according to FIG. 8 distinguishes itself in that the outer casing 20 of the muffler housing 18 includes the protective wall 36 as a double wall, and an air insulation gap 40 is formed between the two. The air insulation gap 40 prevents the outer casing 20 from being damaged or even destroyed by the influence of excessive temperatures. The protective wall 36 preferably is a microperforated metal foil here, in particular a microperforated steel foil which, in addition to the thermal shielding of the outer casing 20, also provides for an additional muffling of the exhaust muffler 10. Owing to the thermal shielding provided by the protective wall 36, the temperature of the outer casing, which is made at least partly from a plastic material, remains below the melting temperature of the plastic material used, that is, typically below 200° C., in particular below 180° C., so that the plastic material is not damaged.

Figure 9:
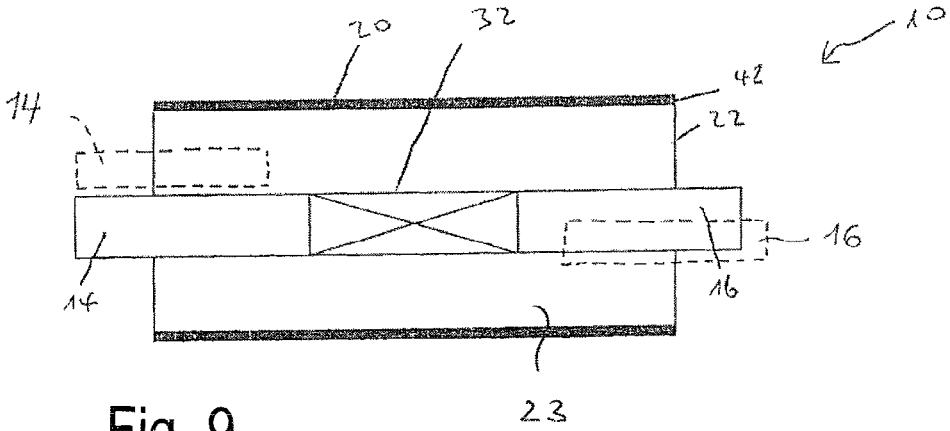
FIG. 9 shows a longitudinal sectional view of a further exhaust muffler according to the invention with an internal coating.

Instead of an air insulation gap 40 in the muffler housing 18, an internal coating 42 of the outer casing 20 may be provided, as shown in FIG. 9. The internal coating 42 is preferably made from a thermally more stable material than the plastic material used for the outer casing 20. For the stabilization of the outer casing 20, it may be sufficient if the internal coating 42 extends only over sections of the inside of the outer casing 20. By analogy with the protective wall 36, the internal coating 42 may be formed as a microperforated foil and fastened to stiffening ribs 56 of the muffler housing 18, for example, as will be discussed in greater detail below with reference to FIGS. 10 and 11.

Figure 10:
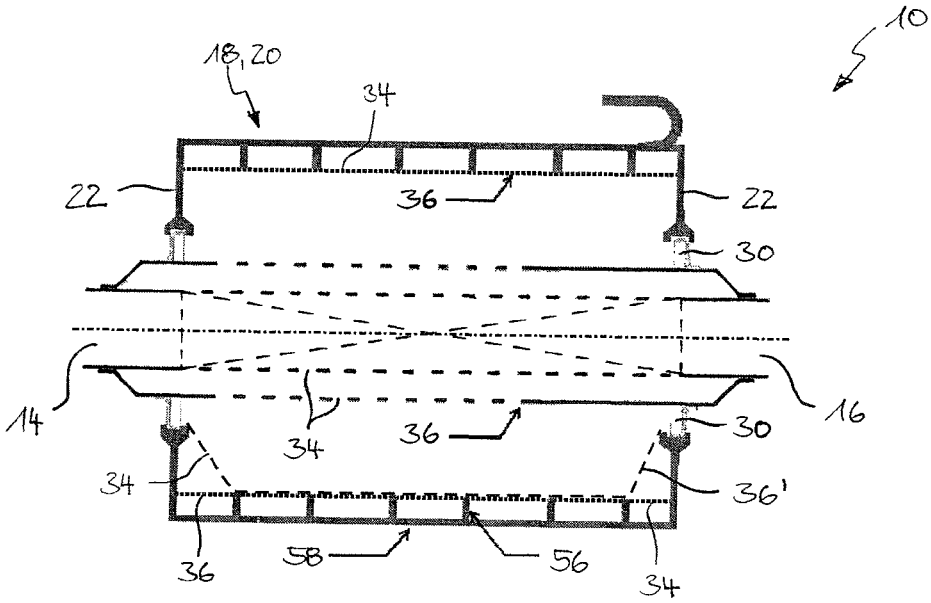
FIG. 10 shows a longitudinal sectional view of a further exhaust muffler according to the invention.

FIG. 10 shows an embodiment of the exhaust muffler 10 which, proceeding from a structural construction of the exhaust muffler 10 according to FIG. 5, includes a (further) protective wall 36 for thermal shielding of the muffler housing 18. In this case, the outer casing 20, which is manufactured from a plastic material, comprises stiffening ribs 56 which are integrally molded with an outer skin 58 of the outer casing 20. The stiffening ribs 56 radially extend into the interior of the muffler housing 18 and are statically necessary for, or at least of advantage to, the stabilization of the muffler housing 18. The protective wall 36 is mounted on an inside of the stiffening ribs 56; optionally, provision may be made for a poorly heat-conducting or thermally insulating layer between the protective wall 36 and the stiffening ribs 56 in order to minimize the transfer of thermal energy of the exhaust gas via the protective wall 36 into the muffler housing 18, specifically into the stiffening ribs 56 of the muffler housing 18. The poorly heat-conducting layer may be an adhesive agent, for example, which is used for adhesively bonding the protective wall 36 onto the stiffening ribs 56.

According to FIG. 10, aside from the outer casing 20, sections of the end walls 22 are also produced from a plastic material and are integrally connected with the outer casing 20. Preferably, the entire muffler housing 18, made of a plastic material, is then shielded on the inside by the protective wall 36 from the hot exhaust gas flow, as is indicated by the protective wall 36'. As an alternative, it is however also conceivable that only thermally highly stressed portions, for example those directly struck by the flow of exhaust gas, are shielded by the protective wall 36.

In the present case, the protective wall 36 is a microperforated metal foil which, in addition to the thermal shielding of the muffler housing 18, also provides for acoustic advantages, that is, a better muffling of the exhaust muffler 10. In this connection, "metal foils" should be understood to mean flexible metal sheets having a thickness t of $t \leqq 250$ μm, in particular of $50\ \mu m \leqq t \leqq 100\ \mu m$ (cf. FIG. 11).

Figure 11:
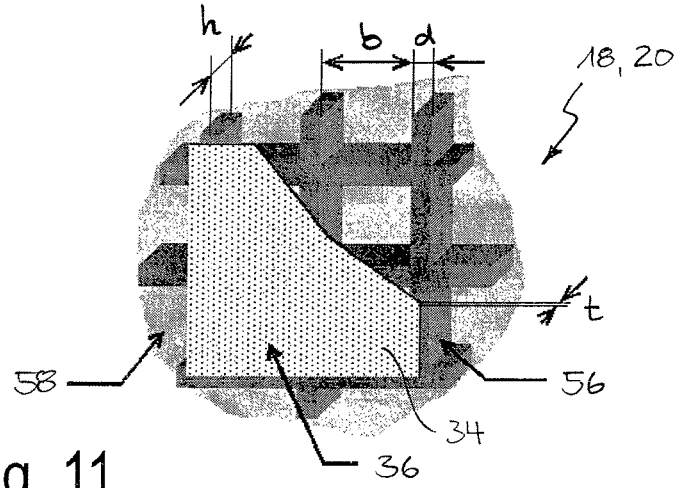
FIG. 11 shows a detail view of the exhaust muffler according to FIG. 10.
Figure 12:
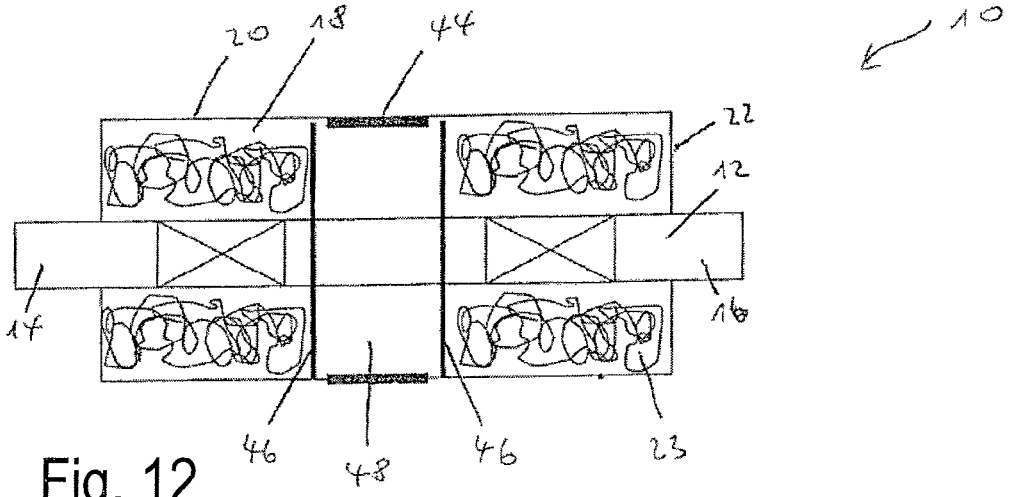
FIG. 12 shows a longitudinal sectional view of a further exhaust muffler according to the invention with support walls.

FIG. 11 shows an interior view of the outer casing 20 in detail. The outer casing 20, which is produced from a plastic material, here comprises the outer skin 58 and the integrally molded stiffening ribs 56 which extend radially into the interior of the muffler housing 18 and have the protective wall 36 fastened to their insides. The stiffening ribs 56 are arranged in the nature of a grid and have a distance b from each other both in the axial direction and in the peripheral direction. Together with the distance b, the rib thickness d can be used to adjust the stability of the muffler housing 18, whereas the thermal shielding is hardly affected. A rib height h, on the other hand, mainly has an effect on the thermal shielding, but a lesser effect on the mechanical stability of the muffler housing 18. A further advantageous embodiment of an exhaust muffler 10 is illustrated in FIG. 12. A preferably metallic cylindrical ring 44 is arranged in the interior of the muffler housing 18.

The pipe sections 14, 16 each project through an end wall 22 of the housing 18 and pass through the ring 44.

The ring 44 rests by its outer periphery against the outer casing 20 and serves as a support wall in the housing 18; this considerably contributes to the mechanical stability of the entire exhaust muffler 10. A plurality of rings 44 may, of course, also be inserted into a muffler housing.

Annular disks 46 are provided laterally next to the axial ends of the ring 44, the annular disks 46 resting against the outer periphery of the pipe 12 and against the inner periphery of the outer casing 20. The annular disks 46 serve as a support wall for the outer casing 20 and separate the axially outer muffling spaces 23, which are filled with a sound absorbing material, from a central space 48, which is not filled with a sound absorbing material.

Independently of all embodiments, it is generally applicable that the pipe sections 14, 16 may be part of a continuous pipe 12 that completely extends through the outer casing, or may be formed by two pipes spaced from each other, which are spaced from each other in the interior of the housing.

Figure 13:
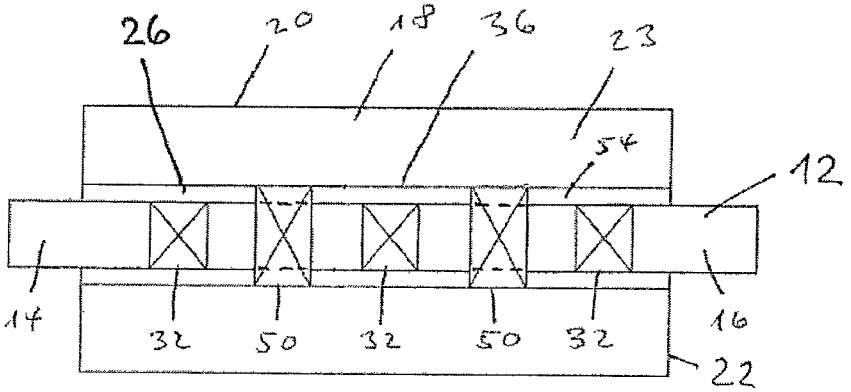
FIG. 13 shows a longitudinal sectional view of a last embodiment of the exhaust muffler according to the invention with pipes fitted into each other.

In the embodiment according to FIG. 13, the pipe sections 14, 16 are formed by a common pipe 12 which extends through the entire housing. The pipe 12 has a plurality of portions 32 with radial openings, which may partly or fully be formed by perforations.

The pipe 12 is surrounded by an outer pipe which forms a protective wall 36. An annular intermediate space 54 is obtained between the pipe 12 and the protective wall 36. The protective wall 36 also has portions 50 with openings which also may, in part or in full, be formed by microperforations. The muffling space 23 is open towards the interior of the pipe 12 due to the radial openings.

In this embodiment, the portions 32 and 50 with the openings are axially offset in relation to each other and do not overlap; however, axial overlaps may also be provided. The offset of the openings is intended to prevent the plastic outer casing 20 from being directly impinged by hot exhaust gas.

The individual openings in all of the embodiments may be designed at least partly as microperforations having a maximum flow cross-section of less than 1.5 $mm^2$, in particular less than 1 $mm^2$. These dimensions generally apply to the definition of microperforations in the present case.

Furthermore, it is also generally applicable that the muffling space 23 may optionally be filled with a sound absorbing material. Preferably, at least in those mufflers which are shown without a sound absorbing material in the form of a type of wool, no sound absorbing material at all is present as filling material in the interior. In the case of those embodiments having a filling material in the form of a sound absorbing material, the latter may also be omitted. In no case, however, is the entire interior space between the gas-carrying inner pipe and the muffler housing completely filled with a sound absorbing material.

In all of the embodiments, the pipe 12 runs completely through the muffler housing. However, embodiments would also be conceivable in which an inlet pipe and an outlet pipe separate therefrom constitute the pipe sections on the inflow side and on the outflow side. This is indicated by broken lines in FIG. 9. The inlet pipe and the outlet pipe may also be positioned so as to be radially offset in relation to each other here, but this is not absolutely necessary.

It is, of course, also possible to combine the features of the various above-described embodiments with one another, so that further embodiments will result. For example, an exhaust muffler which, in the muffler housing, includes a protective wall in particular with radial openings, which has an outer casing comprised, at least partly, of a plastic material, and in which a sleeve that includes radial cooling fins is inserted between the end wall and the outer casing is likewise part of the invention disclosed.

Although embodiments of this invention have been disclosed, a worker of ordinary skill in this art would recognize that certain modifications would come within the scope of this invention. For that reason, the following claims should be studied to determine the true scope and content of this invention.

The invention claimed is:

1. An exhaust muffler of an internal combustion engine, comprising:

at least one pipe section on an inflow side and at least one pipe section on an outflow side;

a muffler housing that is in communication with the pipe sections, wherein the muffler housing is made at least partly of a plastic material, and wherein at least portions of the pipe sections which are located in an interior of the muffler housing are provided with openings comprising microperforations; and wherein the housing of plastic material includes at least in sections an internal coating made from a thermally more stable material than the plastic material, and wherein the internal coating is applied at axial locations along the housing that correspond to the openings in the portions of the pipe sections, and wherein the openings and the internal coating are separated by a radial distance.

2. The exhaust muffler according to claim 1, wherein the muffler housing includes an outer casing and end walls, at least the outer casing being made at least in sections of a plastic material.

3. The exhaust muffler according to claim 2, wherein the outer casing continues in one piece into at least one of the end walls.

4. The exhaust muffler according to claim 2, wherein the end walls include at least in sections a thermally insulating material to reduce heat conduction to the outer casing.

5. The exhaust muffler according to claim 2, wherein cooling fins are attached to at least one end wall or a transition between the at least one end wall and an adjacent pipe section.

6. The exhaust muffler according to claim 2, wherein at least one end wall is manufactured from a plastic material, and a cylindrical sleeve is arranged between the at least one end wall and an associated pipe section and has a surface that is enlarged with radial fins.

7. The exhaust muffler according to claim 6, wherein the cylindrical sleeve is manufactured from a material having a low thermal conductivity.

8. The exhaust muffler according to claim 2, wherein a connector ring is provided which encloses inner or outer edges of the end walls and provides a transition to the outer casing.

9. The exhaust muffler according to claim 1, wherein two pipes extend through the muffler housing with an axial offset of sectional perforations.

10. The exhaust muffler according to claim 2, wherein a protective wall made of metal is disposed between at least one the pipe section located in an interior of the muffler housing and the outer casing.

11. The exhaust muffler according to claim 10, wherein the protective wall is fastened to the at least one pipe section and/or to at least one end wall and is open towards a muffling space between the outer casing and the protective wall.

12. The exhaust muffler according to claim 2, wherein at least one support wall formed as an annular disk is located in an interior of the muffler housing to be spaced from both end walls and includes a first portion that rests against a pipe section and a second portion that rests against the outer casing.

13. The exhaust muffler according to claim 2, wherein the outer casing includes metal sections.

14. The exhaust muffler according to claim 2, wherein a space between the outer casing and the at least one pipe section is filled with a sound absorbing material.

15. The exhaust muffler according to claim 10, wherein the protective wall projects through the muffler housing on both sides, and the end walls are fastened to the protective wall.

16. An exhaust muffler of an internal combustion engine, comprising:

at least one pipe section on an inflow side and at least one pipe section on an outflow side;

a muffler housing that is in communication with the pipe sections wherein the muffler housing is made at least partly of a plastic material and wherein the muffler housing includes an outer casing and end walls, at least the outer casing being made at least in sections of a plastic material; and a protective wall made of metal disposed between at least one the pipe section located in an interior of the muffler housing and the outer casing, wherein the protective wall represents a radially outer termination of a muffling space within the muffler and is spaced from the outer casing by an air insulation gap.

17. The exhaust muffler according to claim 16, wherein at least one section of the protective wall is positioned radially between a center section of the outer casing and the pipe section.

18. An exhaust muffler of an internal combustion engine, comprising:

at least one pipe section on an inflow side and at least one pipe section on an outflow side;

a muffler housing that is in communication with the pipe sections, wherein the muffler housing is made at least partly of a plastic material, and wherein the muffler housing includes an outer casing and end walls, at least the outer casing being made at least in sections of a plastic material; and a protective wall made of metal disposed between at least one the pipe section located in an interior of the muffler housing and the outer casing, wherein the protective wall has radial openings comprising microperforations.

19. The exhaust muffler according to claim 18, wherein at least one section of the protective wall is positioned radially between a center section of the outer casing and the pipe section.

20. An exhaust muffler of an internal combustion engine, comprising:

at least one pipe section on an inflow side and at least one pipe section on an outflow side;

a muffler housing that is in communication with the pipe sections, wherein the muffler housing is made at least partly of a plastic material, and wherein the muffler housing includes an outer casing and end walls, at least the outer casing being made at least in sections of a plastic material; and a protective wall made of metal disposed between at least one the pipe section located in an interior of the muffler housing and the outer casing, wherein sections of the muffler housing comprised of the plastic material include stiffening ribs extending into an interior of the muffler housing, the protective wall being mounted on an inside of the stiffening ribs.

21. The exhaust muffler according to claim 20, wherein at least one section of the protective wall is positioned radially between a center section of the outer casing and the pipe section.

* * * * *